US006066799A

United States Patent [19]

Nugent

[11] Patent Number: 6,066,799

[45] **Date of Patent: *May 23, 2000**

[54] TWISTED-PAIR CABLE ASSEMBLY

[76] Inventor: Steven Floyd Nugent, 3240 NW. 132 Pl., Portland, Oreg. 97229

[ * ] Notice: This patent is subject to a terminal disclaimer.

[21] Appl. No.: 09/223,619

[22] Filed: Dec. 30, 1998

[51] Int. Cl.[7] ..... H01B 11/02

[52] U.S. Cl. ..... 174/27; 174/113 R

[58] Field of Search ..... 174/27, 28, 113 R, 174/25 G, 26 G, 71 R

[56] References Cited

U.S. PATENT DOCUMENTS

| | | | |
|---|---|---|---|
| 2,119,853 | 6/1938 | Curtis | 174/27 X |
| 3,249,901 | 5/1966 | Spinner . | |
| 3,448,222 | 6/1969 | Greber | 174/27 X |
| 3,542,938 | 11/1970 | Graneau | 174/28 |
| 3,717,718 | 2/1973 | Schmidtchen | 174/27 X |
| 3,821,465 | 6/1974 | Karlstedt . | |
| 3,892,912 | 7/1975 | Hauck . | |
| 3,917,898 | 11/1975 | Iketani et al. | 174/15 C |
| 4,037,083 | 7/1977 | Leavines | 219/552 |
| 4,208,542 | 6/1980 | Endo . | |
| 4,538,023 | 8/1985 | Brisson . | |
| 4,581,478 | 4/1986 | Pugh et al. | 174/25 X |
| 4,705,914 | 11/1987 | Bondon | 174/28 |
| 4,767,890 | 8/1988 | Magnan . | |
| 4,873,393 | 10/1989 | Friesen et al. . | |
| 4,997,992 | 3/1991 | Low . | |
| 5,095,178 | 3/1992 | Hollingsworth | 174/71 R X |
| 5,149,915 | 9/1992 | Brunker et al. . | |
| 5,334,271 | 8/1994 | Bullock et al. . | |
| 5,459,284 | 10/1995 | Bokelman et al. | 174/27 X |
| 5,471,010 | 11/1995 | Blockelman et al. . | |
| 5,510,578 | 4/1996 | Dunlavy . | |
| 5,544,270 | 8/1996 | Clark et al. . | |
| 5,606,151 | 2/1997 | Siekierka et al. | 174/113 R |
| 5,689,090 | 11/1997 | Bleich et al. | 174/113 R X |
| 5,831,210 | 11/1998 | Nugent . | |

*Primary Examiner*—Kristine Kincaid
*Assistant Examiner*—Chau N. Nguyen

[57] ABSTRACT

An improved twisted-pair interconnect includes a first conductor and second conductor. Over the first half of the interconnect the first conductor is uninsulated and the second conductor is insulated. Over the second half of the interconnect the first conductor is insulated and the second conductor is uninsulated. An insulation barrier is provided at the midpoint of the interconnect to prevent shorting. In a further improvement, the twisted-pair cable is constructed from an insulated and an uninsulated conductor which are twisted together, severed at a midpoint, and reconnected with the conductors swapped, causing each conductor to be half-insulated and both conductors to have the same length. To reduce electromagnetic coupling and preventing external contact with the uninsulated conductors, the twisted-pair can be enclosed by flexible straight or grooved gas-filled tubing. The grooves can be radial, axial or helical and serve to center the twisted-pair within the tubing while contacting the twisted-pairs as little as possible. Multiple twisted-pairs of the invention, each enclosed by a flexible tubing section, can also be bundled together and connected in parallel to form an improved loudspeaker interconnect.

21 Claims, 9 Drawing Sheets

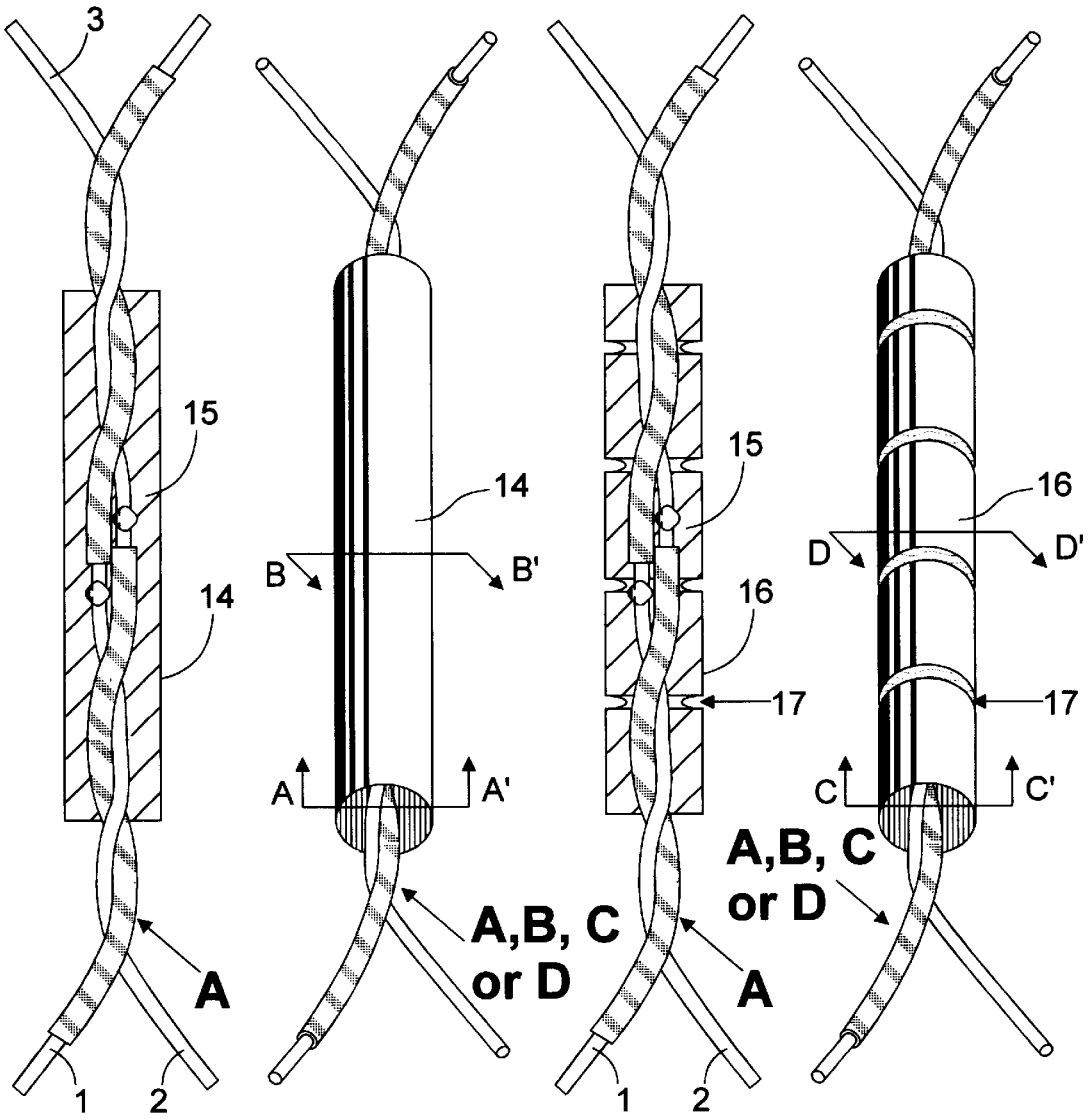
Fig 5a (Section A-A')
Fig 5c
Fig 6a (Section C-C')
Fig 6c
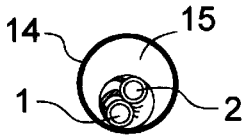
Fig 5b
(Section B-B')
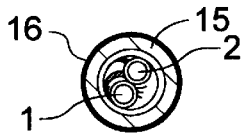
Fig 6b
(Section D-D')

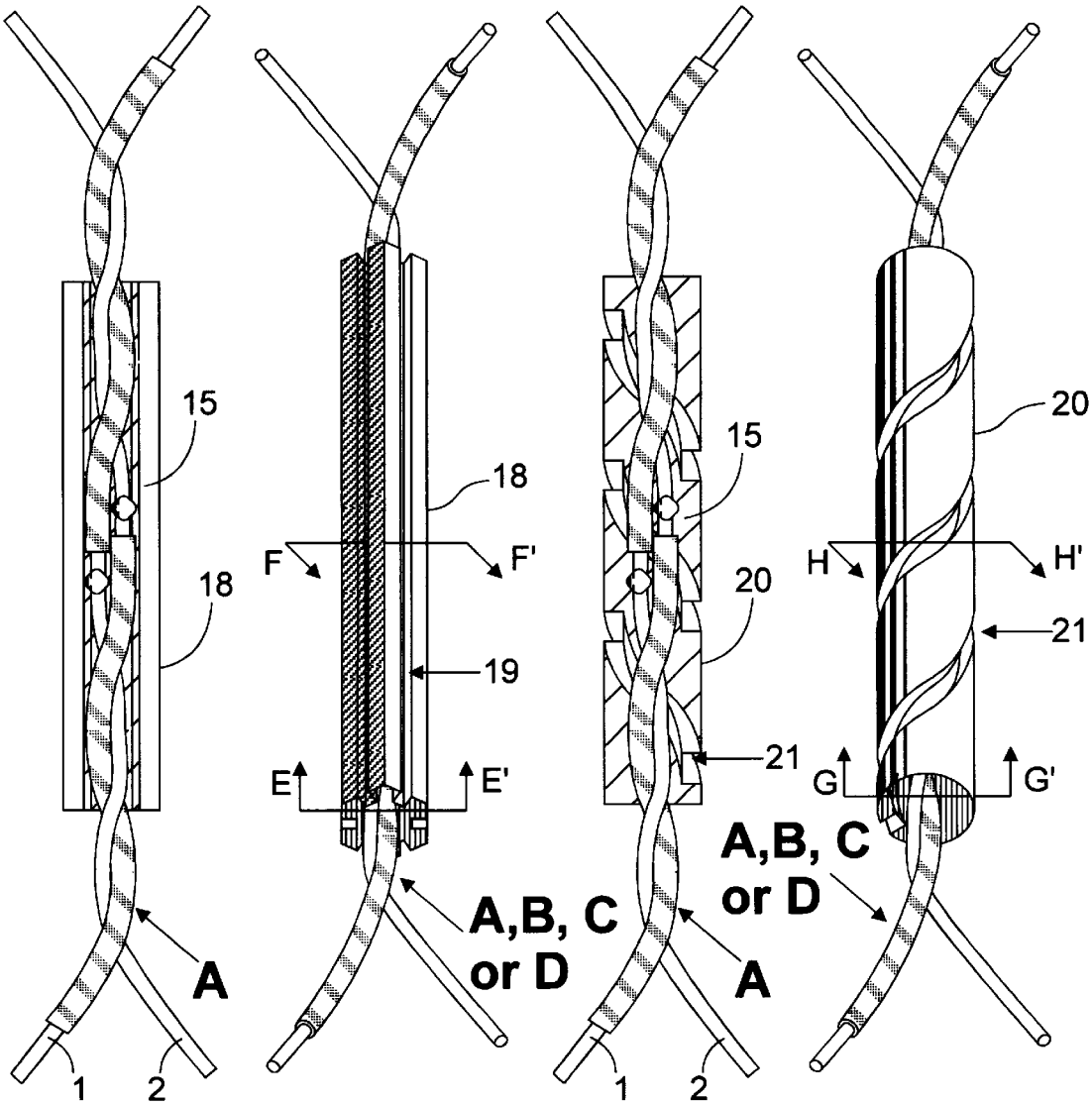
Fig 7a (Section E-E')
Fig 7c
Fig 8a (Section G-G')
Fig 8c
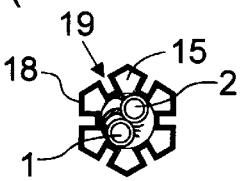
Fig 7b
(Section F-F')
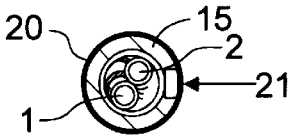
Fig 8b
(Section H-H')

TWISTED-PAIR CABLE ASSEMBLY

BACKGROUND OF THE INVENTION

1. Field of the Invention

The present invention relates to the field of audio electronics, and in particular to interconnect cables and loudspeaker cables.

2. Description of the Related Art

Twisted-pairs of conductors are used for transmission of audio signals because they have inherent noise rejection properties. When a twisted-pair is used for balanced signaling, the two conductors must be identical in length to insure that the signals carried on both conductors arrive in phase at the destination. Equal conductor lengths can improve the signal quality in unbalanced signaling situations as well. This is due to the voltage dividing effect of the forward and return conductors of the twisted-pair. If the voltage drop across the forward path and the return path are not identical across all audio frequencies, then this can cause small, but audible voltage shifts at the cable destination. Unfortunately, achieving equal length of the conductors is difficult and costly with current manufacturing methods. Twisted-pairs are typically fabricated by twisting machines which rotate a frame containing two spools of insulated wire. As the twisted-pair pays out of the twisting machine, the two spools pay out wire under tension in order to equalize their lengths. The spools must have identical tension to maintain uniform twisting and result in equal length of the two conductors. This is process is very difficult to control and systems that control this effectively add significant cost to the twisted-pairs. As a result, the lengths of the conductors in inexpensive twisted-pairs are typically unequal, however one conductor is consistently longer than the other in a given manufacturing run.

Ideally, interconnects for high-fidelity audio transmission should utilize uninsulated conductors. The earliest high-bandwidth cable designs used spacers which supported uninsulated twisted conductors, particularly those used for video and TV transmission. With the advent of low-dielectric constant insulation materials, most cable manufacturers abandoned uninsulated wire designs in favor of these new materials. In some high-bandwidth designs, air is captured within the dielectric material as pockets, tubes or bubbles. Even the best modern insulation materials exhibit undesirable characteristics over the wide bandwidth of audio frequencies. These undesirable characteristics include: high dielectric constant, dielectric absorption and dielectric loss. These characteristics cause the transfer function of the conductors to vary depending upon amplitude and frequency, thereby degrading the signal quality. High dielectric constants also cause high-frequency roll-off by increasing capacitance between the conductors. Air-filled and low dielectric constant materials approach the ideal of air dielectric, but still suffer from frequency dependent effects and generate undesirable noise. Twisted-pair designs could utilize one bare and one insulated wire as an improvement over the typical insulated twisted-pair. However, even in this configuration one conductor experiences the frequency/amplitude-dependent effects of the insulation and the other does not. This creates a varying impedance that causes the signal voltage to vary with frequency at the cable destination, introducing noise into the signal. It is even more difficult to maintain equal conductor lengths when this insulated/uninsulated twisted-pair is manufactured.

Unlike line-level signal cables, cables for the transmission of audio signals between power amplifiers and loudspeakers must transfer high power over a wide range of frequencies without altering the original signal, often into a very reactive loudspeaker load, the impedance varying as a function of frequency. Loudspeakers are generally less than ideal loads for amplifiers to drive due to their inherent inductance and the complex impedance of their crossovers. Amplifiers are often sensitive to the load that the cable/loudspeaker combination presents to them as well and can oscillate or otherwise become unstable if the capacitance or inductance of the cable/loudspeaker combination is too high. In general, obtaining the lowest possible inductance and capacitance is the goal in designing a superior high-fidelity speaker cable. To achieve low inductance, many loudspeaker cable designs simply utilize large conductors, often 10–12 gauge stranded or solid. As the conductors are made larger, their self-inductance decreases. However, this technique is not optimum for audio because these cables experience high-frequency distortion due to skin-effect. When the current density across the cross-section of the conductor varies as a function of frequency, this is skin-effect. The high-frequencies tend to run on the outer skin of the conductor, while the low-frequencies tend run in the center of the conductor. Skin-effect causes the impedance of the conductors and signal velocity to change as a function of frequency and current magnitude.

Most cable designs that minimize skin-effect do so by utilizing "Litz-wire", such as that taught in the inventions of Magnan (U.S. Pat. No. 4,767,890), Low (U.S. Pat. No. 4,997,992) and Brisson (U.S. Pat. No. 4,538,023). In these constructions each conductor typically consists of a large group of individually insulated small-gauge wires, each group having it's ends electrically combined by stripping the insulation. These Litz-wire designs minimize skin-effects by using sufficiently small gauge conductors while the combination of parallel wires reduces the cable inductance. However, even the Litz-wire does not achieve the minimum possible inductance. The inductance of the Litz-wire is limited to the self-inductance of the wire. In some constructions, the fields created by the Litz-wires can couple with other adjacent wires in the bundle increasing or decreasing the impedance of the cable dynamically with the current transients depending upon the magnitude of the currents and associated fields. The impedance can increase or decrease depending upon whether the adjacent wires are coupled by common-mode or differential-mode currents respectively.

Multiple twisted-pair designs such as that taught by Dunlavy (U.S. Pat. No. 5,510,578) minimize skin-effects by utilizing multiple small-gauge conductors that are ganged together like the Litz-wire designs. Twisting the wire pairs tightly together further reduces the inductance of these designs over the non-twisted Litz-wire designs because it creates mutual inductance between the conductors of each pair. Twisted-pairs also have the added advantage of common-mode noise rejection and cancellation of fields at far-field locations from each pair. However, the Dunlavy twisted-pair design locates the pairs in near-field positions with respect to each other with dielectric materials acting as fillers/spacers. In these near-field positions, the magnetic fields from each twisted pair cannot cancel due to flux-lines being broken by close proximity of conductors from other pairs. Capacitive and magnetic coupling can also occur between pairs if they are too close or if they have high dielectric-constant fillers between them. This coupling can cause the cable impedance to fluctuate with high current and voltage transients. These impedance fluctuations can cause phase-shifts in the signals being transferred over the cables which can result in audible distortion.

SUMMARY OF THE INVENTION

The present invention finds application in the field of high-fidelity audio, and particularly to audio cables. The present invention is a twisted-pair interconnection cable that can be used for balanced or single-ended audio signal transmission or (configured in a multiple-pair arrangement for transmission between power amplifiers and loudspeakers.

A twisted-pair cable according to the present invention begins with a first conductor which is uninsulated and a second conductor which is insulated. The first and second conductors are then length equalized by severing, swapping and reconnecting the two conductors at the midpoint of the cable. The reconnected cable that results consists of a first conductor which is uninsulated over the first half and insulated over the second half and a second conductor which is insulated over the first half and uninsulated over the second half. At the midpoint of the length of the cable, the insulated portions are overlapped to prevent the uninsulated portions from shorting. The construction takes advantage of the fact that the individual lengths of the conductors are consistent and uniform over a short run even though one conductor of the twisted-pair is typically consistently longer than the other in a given manufacturing run. The invention causes the conductor lengths to be effectively equalized and eliminates 50% of the insulation from the conductors while preventing the conductors from shorting to each other. The impedance of the forward current path (first conductor) is identical to the impedance of the return current path (second conductor) over the audio frequency band which eliminates distortion and noise from the audio signal.

This half-insulated twisted-pair construction is also applied to the cable taught in Nugent U.S. Pat. No. 5,831,210, "Balanced Audio Interconnect with Helical Geometry", resulting in improvements of reduced dielectric effects.

A loudspeaker cable according to the present invention consists of a plurality of twisted-pairs forming a bundle, each twisted-pair being surrounded by an air-filled flexible tube that separates each of the pairs from the others. At the terminations at both ends of the cable, the twisted-pairs emerge from the tubing. Where the twisted-pairs emerge, the positive conductors from all pairs are stripped of insulation and combine to form a positive group. Similarly, the negative conductors from all pairs are stripped of insulation and combine to form a negative group. The tubing serves to separate the twisted-pairs from each other by inserting as much air as possible between them. This construction is an improvement over the prior art because by spacing the twisted-pairs in air-filled tubing, it significantly reduces the capacitive and inductive coupling between adjacent pairs which can cause distortion in the audio signal. Also, eliminating half of the insulation from the twisted-pairs improves the quality of transmission by reducing the dielectric effects of the insulation.

As a feature of the present invention, a twisted-pair is severed at the midpoint, the pairs are reversed and reconnected. This compensates for differences in the impedance of the two conductors due to material or length variations. The result is that the two conductors have equal length and identical impedance. For balanced interconnects, this guarantees that the flight-times of the two signals involved are identical.

As another feature of the preferred embodiment of the present invention, the conductors of each pair are uninsulated over approximately half of their length. The first half of the first conductor is uninsulated and the second half of the second conductor is uninsulated. At the midpoint, the insulation can be overlapped, preventing shorting of the two conductors when they are twisted together. This configuration maintains identical impedance of the two conductors while eliminating nearly 50% of dielectric material in contact with the conductors thereby improving signal quality.

As yet another feature of the present invention, multiple twisted pairs are bundled to form a loudspeaker cable wherein the first conductor from all pairs is grouped and the second conductor from all pairs is grouped at each cable end and each individual twisted-pair is surrounded by flexible tubing that serves to separate each pair from the other pairs in the bundle. Separating the twisted-pairs from each other by using mostly air in the space between them significantly reduces the coupling between them. This coupling can change the impedance of the cable dynamically when current transients occur, causing degradation in the audio signal.

As yet another feature of the present invention, the flexible tubing surrounding each twisted-pair can include radial or axial corrugations which serve to center the twisted-pairs within the air-filled tubing. Centering the pairs within the tubing achieves a more predictable and larger pair-to-pair spacing within the bundle of pairs of the loudspeaker cable and effectively reduces coupling to external objects as well.

The present invention demonstrates improvements and advantages over conventional twisted-pairs in that it causes each of the two conductors to have identical length and impedance while reducing the amount of dielectric material in contact with the conductors. For multiple twisted-pair speaker cables, it also demonstrates improvements over the Dunlavy invention in that the tubing around each twisted-pair reduces coupling between the twisted-pairs within a group and the elimination of half of the insulation reduces dielectric effects. The present invention significantly improves the audio signal transmission quality over both single twisted-pair cables and multiple twisted-pair speaker cabling, providing superior results with a large range of different component and loudspeaker characteristics.

Other objects, advantages and novel features of the present invention will become more apparent from the following detailed description in conjunction with the accompanying drawings.

BRIEF DESCRIPTION OF THE DRAWINGS

FIG. 5*a* illustrates section A–A' of the twisted-pair cable A of the invention enclosed in straight gas-filled tubing.

FIG. 5*b* illustrates section B–B' of the twisted-pair cable A of the invention enclosed in straight gas-filled tubing.

FIG. 5*c* illustrates twisted-pair cable A, B, C or D of the invention enclosed in straight gas-filled tubing.

FIG. 6*a* illustrates section C–C' of the twisted-pair cable A of the invention enclosed in radially grooved gas-filled tubing.

FIG. 6*b* illustrates section D–D' of the twisted-pair cable A of the invention enclosed in radially grooved gas-filled tubing.

FIG. 6*c* illustrates twisted-pair cable A, B, C or D of the invention enclosed in radially grooved gas-filled tubing.

FIG. 7*a* illustrates section E–E' of the twisted-pair cable A of the invention enclosed in axially grooved gas-filled tubing.

FIG. 7*b* illustrates section F–F' of the twisted-pair cable A of the invention enclosed in axially grooved gas-filled tubing.

FIG. 7*c* illustrates twisted-pair cable A, B, C or D of the invention enclosed in axially grooved gas-filled tubing.

FIG. 8*a* illustrates section G–G' of the twisted-pair cable A of the invention enclosed in helically grooved gas-filled tubing.

FIG. 8*b* illustrates section H–H' of the twisted-pair cable A of the invention enclosed in helically grooved gas-filled tubing.

FIG. 8*c* illustrates twisted-pair cable A, B, C or D of the invention enclosed in helically grooved gas-filled tubing.

DETAILED DESCRIPTION OF THE INVENTION

The present invention is a twisted-pair interconnection cable in which the conductor lengths of each twisted-pair are equalized and the conductors may be half-insulated. Each twisted-pair may further be enclosed in insulating gas-filled tubing.

Figures 1, 2, 3, 4:
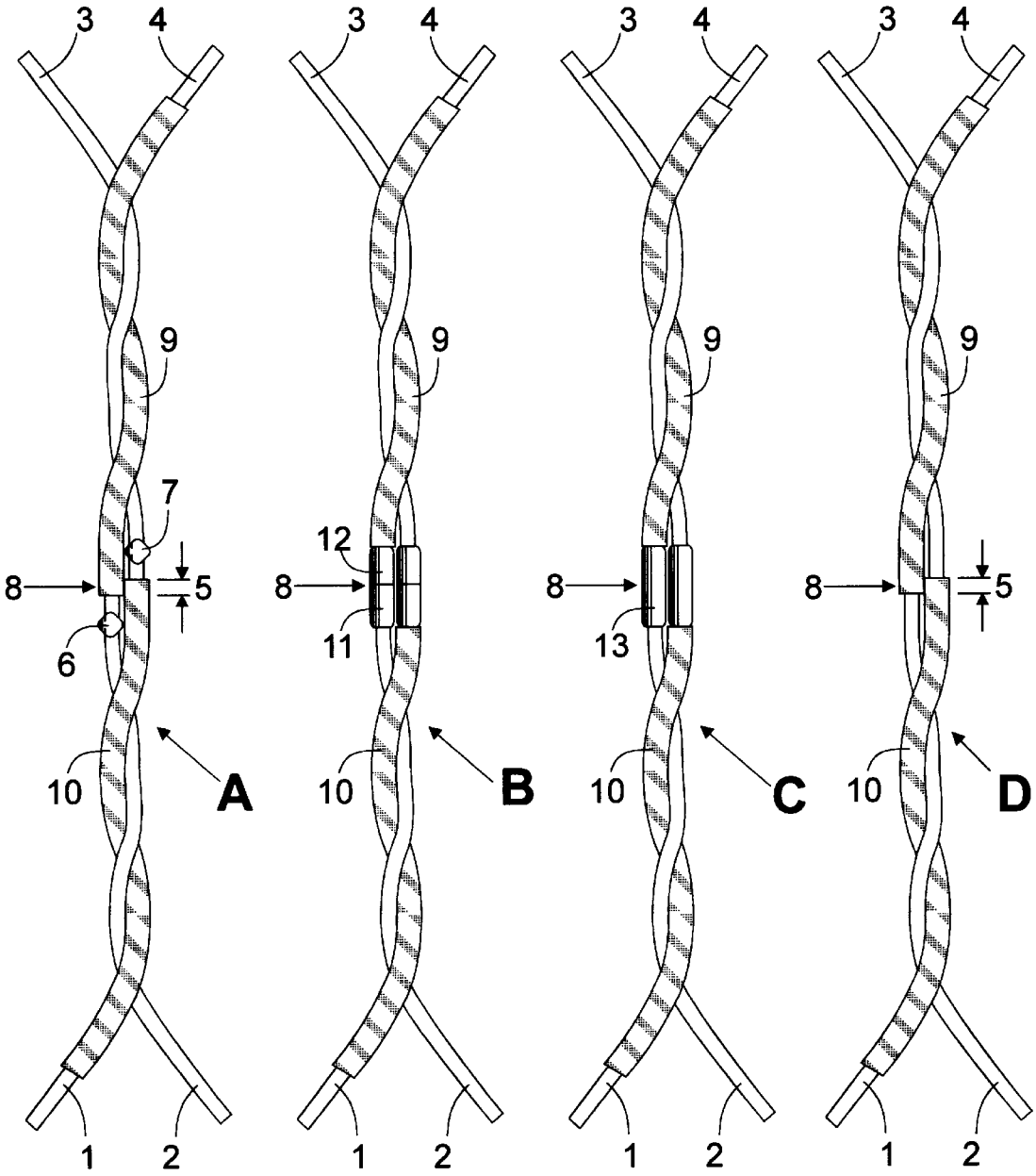
FIG. 1 illustrates twisted-pair cable A of the invention, the preferred embodiment, which utilizes an insulation overlap and permanent connection.
FIG. 2 illustrates twisted-pair cable B of the invention, which utilizes a two-piece connector.
FIG. 3 illustrates twisted-pair cable C of the invention, which utilizes a one-piece connector.
FIG. 4 illustrates twisted-pair cable D of the invention, which utilizes no connection means.

Referring to FIG. 1 of the drawings, the preferred embodiment of the invention A comprises a first insulated conductor 1, a second conductor 2, a third conductor 3 and a fourth insulated conductor 4, of which the conductors are all preferably composed of solid copper, silver, tinned copper or silver plated copper and in the same gauge, generally ranging from 26 AWG to 18 AWG. Insulation 9 and insulation 10 may be composed of PVC, Teflon, polypropylene, polyethylene or other flexible insulating material.

The first half of the twisted-pair cable comprises uninsulated conductor 2 which is twisted with insulated conductor 1. The second half of the cable comprises uninsulated conductor 3 which is twisted with insulated conductor 4. At the midpoint of the cable 8, conductor 2 is electrically connected to insulated conductor 4 and insulated conductor 1 is electrically connected to conductor 3 forming two junctions 6 and 7. To prevent shorting at the junctions 6 and 7, the uninsulated conductors 2 and 3 are generally shortened forming an overlap 5 of the insulated portions 9 and 10. The overlap 5 is generally minimized but a practical length is typically 1" to 3". The ends of insulated conductors 1 and 4 are stripped of insulation to allow termination of both ends of the completed cable to connectors or equipment, providing a forward and a return current path for a signal.

To construct the twisted-pair of FIG. 1, an insulated conductor and an uninsulated conductor of like gauge are first twisted at a uniform twist rate ranging from 9–14 twists per foot. The resulting twisted-pair is then cut at the midpoint of the length of the cable. The cut ends of the uninsulated conductors are then trimmed back one to three inches. The cut ends of the pairs are then switched and connected such that both uninsulated ends connect to both insulated ends. The connections 6 and 7 can be made by twisting the conductors together, welding, soldering, crimping, combinations of these or other electrical joining means, such as connectors. An insulated two-piece connector 11 and 12 can be used to connect the cable halves as in cable B of FIG. 2, wherein overlapping of the insulation at the midpoint of the cable 8 is not necessary. An insulated one-piece crimp connector 13 can also used to connect the cable halves as in cable C of FIG. 3, wherein overlapping of the insulation at the midpoint of the cable 8 is also not necessary. The constructions of cables A, B and C take advantage of the fact that the twist-rate is uniform over the twisted-pair length prior to assembly to insure that the conductor lengths are equal after assembly.

An alternate, but more labor-intensive construction is shown in cable D, FIG. 4, wherein both conductors 1 and 2 are initially completely insulated. Cable D is constructed by stripping the insulation nearly to the midpoint of the length of each conductor prior to twisting them together. The half-insulated conductors 1 and 2 are then twisted together, taking care to insure an overlap of insulation 9 and 10 in region 5. Manufacture of cable D is more difficult because the twist-rate must be tightly controlled to insure that the lengths of conductor 1 and conductor 2 are equalized. It does, however, eliminate an electrical connection on each conductor.

Twisted-pair cables A, B, C and D must be further insulated to prevent shorting to the uninsulated conductors. Traditional methods would enclose the twisted-pairs within conformal PVC or Vinyl jackets and may use fillers to create a tubular shape and prevent chafing of the conductors when flexed. The current invention, however, departs from this by enclosing the cables in loose-fitting gas-filled tubing. Referring to FIGS. 5*a* and 5*b*, the twisted-pair cable A is enclosed in straight insulating tubing 14 which is gas 15 filled and ¼" to ⅜" in diameter. When air is used as the gas filler, this tubing is not sealed at the ends where the conductors emerge, but it could be sealed at the ends if a gas other than air were used. This tubing serves first, to insulate conductors 2 and 3, and second, to prevent twisted-pair cable A from coming too close to other conducting materials which might influence the EM fields that cable A generates. According to FIG. 5*c*, twisted-pair cables A, B, C or D can be enclosed in the loose-fitting tubing 14.

FIGS. 6*a*, 6*b* and 6*c* include improvements to the simple straight tubing of FIGS. 5*a*–5*c*. In FIG. 6*c* the tubing 16 has periodic radial grooves 17 that serve to center the twisted-pair cables A, B, C or D within the tubing 16 as illustrated in FIG. 6*b*. Centering the twisted-pair cable within the tubing guarantees a minimum distance from the twisted-pair cable to any other nearby conductor, thereby decreasing the chance of external influence to the twisted-pair EM field over the simple straight lubing of FIG. 5*c*. The corrugation features 17 are intentionally small to minimize contact area with the twisted-pair conductors 1 and 2 thereby preventing any dielectric effects from influencing the fields generated by the twisted-pair. Alternatives to the cable-centering tubing described in FIGS. 6*a*–*c* are described in FIGS. 7*a*–*c* and FIGS. 8*a*–*c*. The hexagonal tubing 18 of FIG. 7*b* has axial grooves or corrugations 19 to center the twisted-pair cable A. The axial grooves 19 are small to minimize contact area with the twisted-pair conductors 1 and 2 thereby preventing any dielectric effects from influencing the fields generated by the twisted-pair. According to FIG. 7*c*, twisted-pair cables A, B, C or D can be enclosed in the axially grooved tubing 18. An additional advantage of tubing 18 is that it stacks geometrically when bundling multiple-pair cable assemblies, eliminating rotation of the tubing. The tubing 20 of FIG. 8*c* has helical grooves 21 to center twisted-pair cable A. The helical grooves 21 are small to minimize contact area with the twisted-pair conductors 1 and 2, preventing any dielectric effects from influencing the fields generated by the twisted-pair. According to FIG. 8*c*, twisted-pair cables A, B, C or D can be enclosed in the helically grooved tubing 20. Helical grooved tubing 20 is considered the best mode of the invention, since it is fairly easy to manufacture by extrusion, makes minimal contact with the twisted-pair and is effective in holding the twisted-pair centered when the cable is flexed. In the embodiments depicted in FIGS. 6, 7, and 8, the twisted-pair cables are centered within the tubing because radial grooves 17 and axial grooves 19 include ridges or raised portions, and helical grooves 21 include a ridge or raised portion, formed on the internal surface of the tubing l6, 18, and 20 as described above and as shown in the figures.

Figure 9:
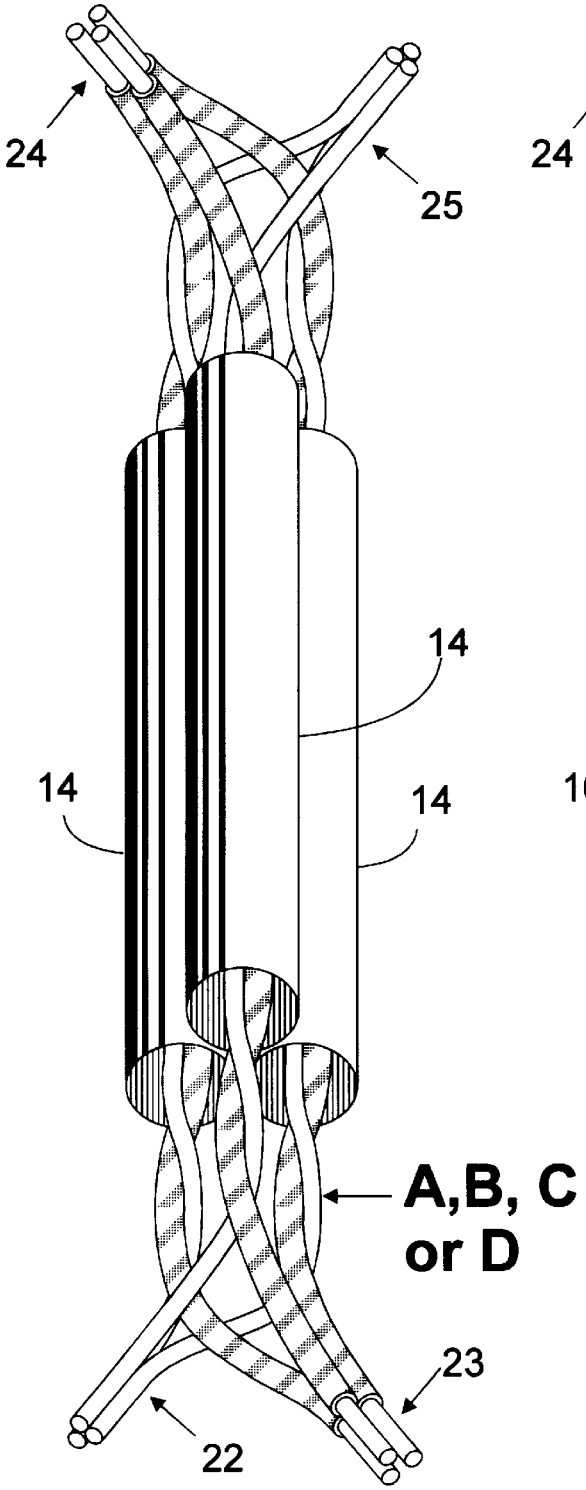
FIG. 9 illustrates a three twisted-pair parallel configuration utilizing twisted-pair cables A, B, C or D each enclosed in straight gas-filled tubing.

Multiple twisted-pair cables (types A, B, C or D) can be enclosed in tubing (types 14, 16, 18 or 20) and combined in parallel to form an exceptional low-inductance interconnect for audio power transmission from power amplifiers to loudspeakers. Referring to FIG. 9, three twisted pair cables A, B, C or D are each shown enclosed in tubing 14 and are combined in parallel to form a loudspeaker cable. At a first end of the cable assembly, the group of uninsulated conductors 22 are electrically combined and the group of insulated conductors 23 are electrically combined. At a second end of the cable assembly, the group of uninsulated conductors 25 are electrically combined and the group of insulated conductors 24 are electrically combined. These are typically electrically combined by inserting them in a connector and soldering or crimping the conductor groups. Conductor groups 22 and 23 can be connected to the positive and negative terminals respectively on a loudspeaker and conductor groups 24 and 25 can be connected to the positive and negative terminals respectively on a power amplifier.

Figure 10:
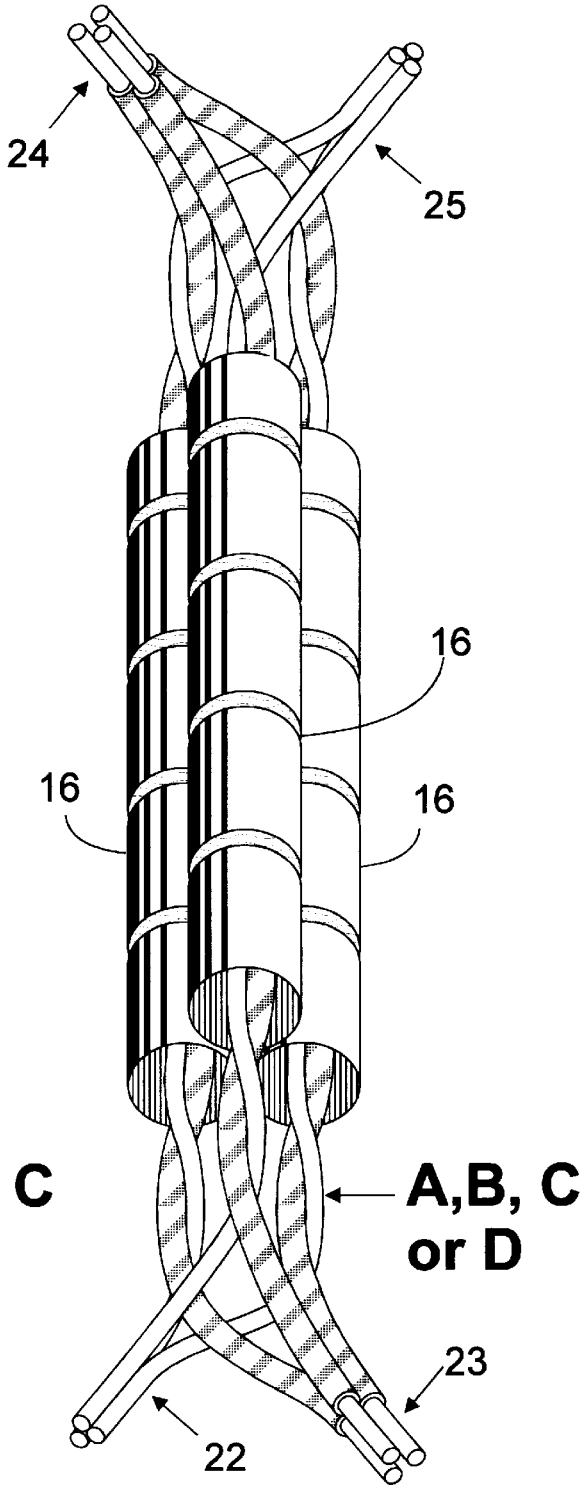
FIG. 10 illustrates a three twisted-pair parallel configuration utilizing twisted-pair cables A, B, C or D each enclosed in radially grooved gas-filled tubing.
Figure 11:
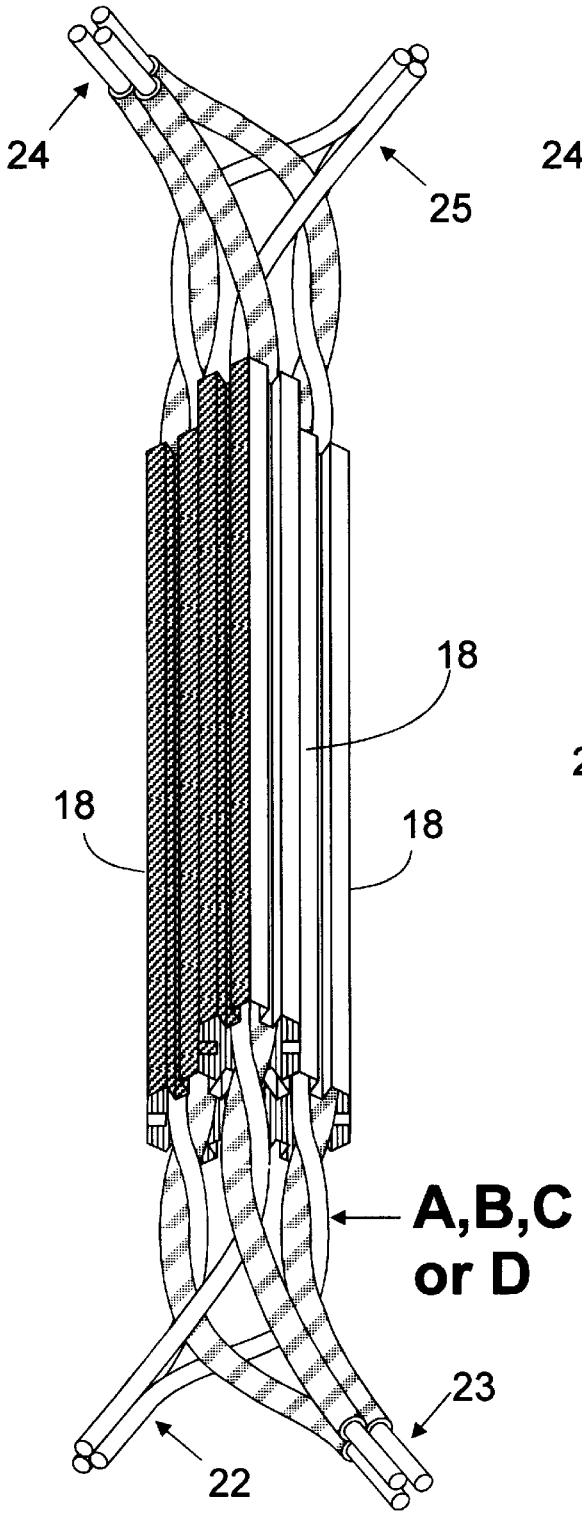
FIG. 11 illustrates a three twisted-pair parallel configuration utilizing twisted-pair cables A, B, C or D each enclosed in axially grooved gas-filled tubing.
Figure 12:
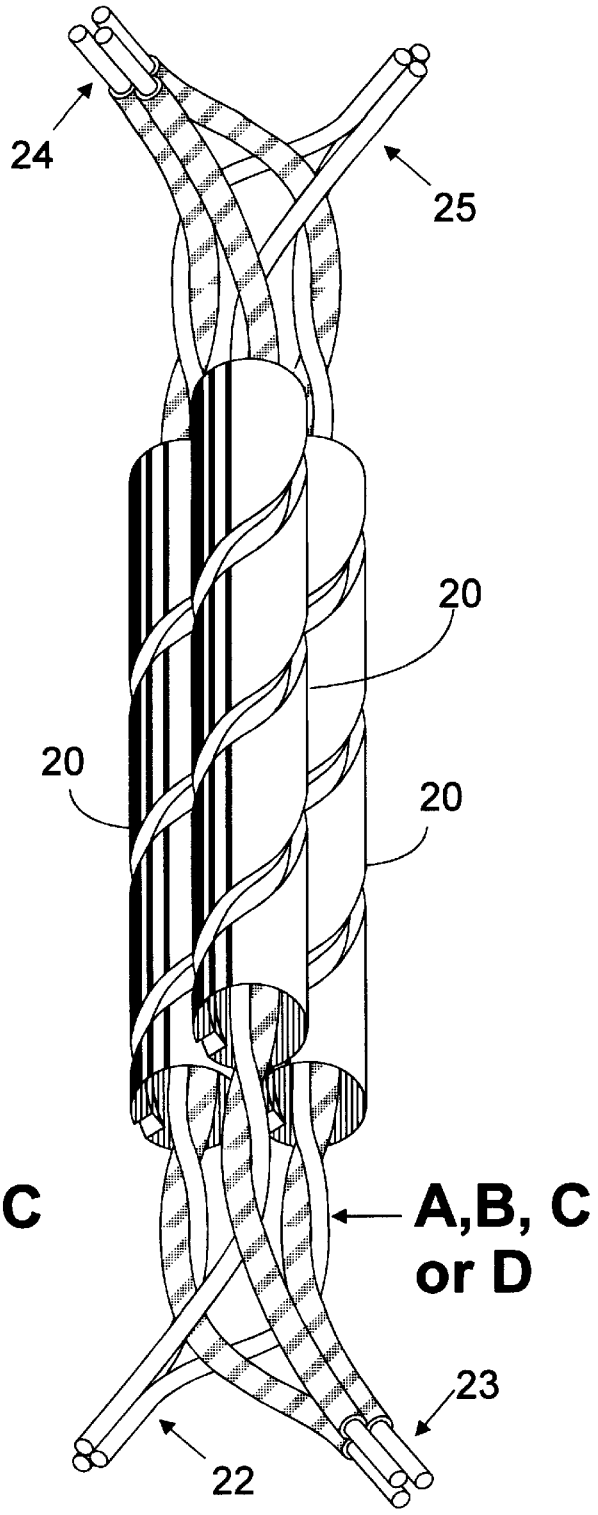
FIG. 12 illustrates a three twisted-pair parallel configuration utilizing twisted-pair cables A, B, C or D each enclosed in helically grooved gas-filled tubing.

FIG. 10 shows three twisted-pair cables A, B, C or D combined in parallel to form a loudspeaker cable using tubing 16 to separate each of the twisted-pairs. FIG. 11 shows three twisted-pair cables A, B, C or D combined in parallel to form a loudspeaker cable using tubing 18 to separate each of the twisted-pairs. FIG. 12 shows three twisted-pair cables A, B, C or D combined to form a loudspeaker cable using tubing 20 to separate each of the twisted-pairs.

Figure 16:
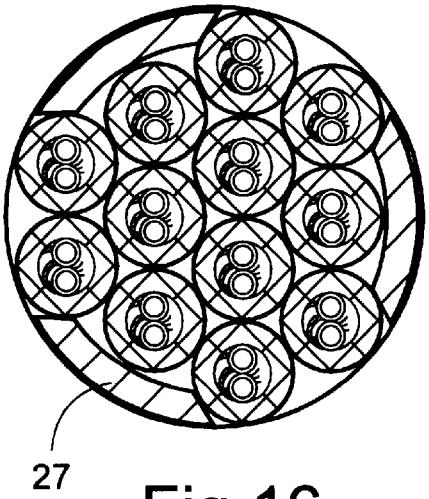
FIG. 16 illustrates a cross-section of a twelve twisted-pair parallel cable using fillers with overall jacket.
Figure 17:
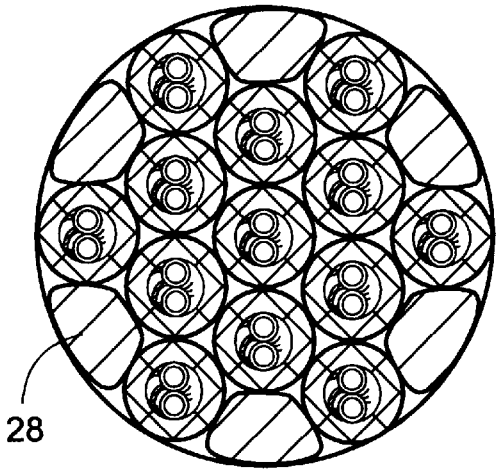
FIG. 17 illustrates a cross-section of a thirteen twisted-pair parallel cable using fillers with overall jacket.
Figure 15:
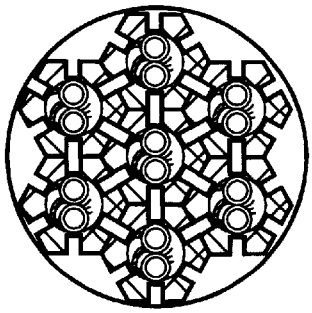
FIG. 15 illustrates a cross-section of a seven twisted-pair parallel cable using hexagonal tubing with overall jacket.
Figure 13A:
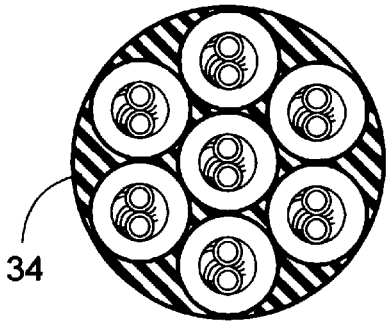
FIG. 13*a* illustrates a cross-section of a seven twisted-pair parallel cable installed in a single-piece molded multi-tunnel sheath.
Figure 13:
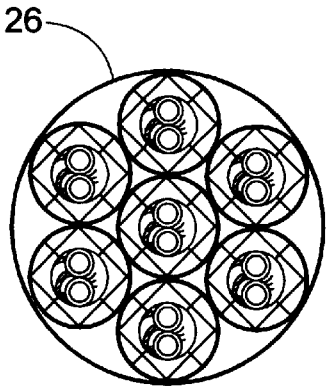
FIG. 13 illustrates a cross-section of a seven twisted-pair parallel cable with overall jacket.
Figure 14:
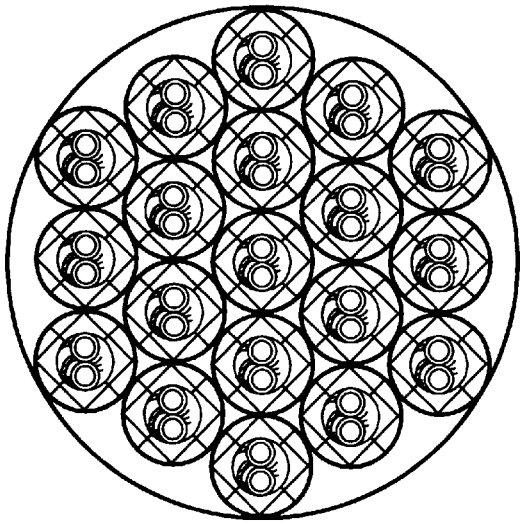
FIG. 14 illustrates a cross-section of a nineteen twisted-pair parallel cable with overall jacket.

Two or more twisted-pair cables (types A, B, C or D), each enclosed in tubing (types 14, 16, 18 or 20) can be combined in parallel to form a loudspeaker cable or analog power-transmission cable. Typical power amplifier and loudspeaker electrical characteristics along with the frequency range of interest dictate the number of twisted-pairs and the conductor wire gauge required to optimize the quality of signal transmission. To optimize the high-frequency response of the cable assembly, the wire gauge is limited to about 20 AWG due to skin-effect. Improved high-frequency response will generally be achieved with smaller diameter gauges (22–26 AWG). To optimize the bass response and dynamics of the cable assembly, a sufficient number of pairs must be connected in parallel to achieve a low inductance. Empirical evidence has shown that a point of diminishing returns is reached when the sum of the cross-sectional area of the twisted-pairs is equivalent to the cross-sectional area of a single 12–13 AWG conductor. As the conductor gauge is decreased (larger diameter), fewer twisted-pairs are required to meet this criteria. For example, using 20 AWG conductors, only 6 twisted-pairs are required. If 22 AWG twisted-pairs are used, at least 9 pairs are required. If 24 AWG twisted-pairs are used, at least 13 pairs are required. To accommodate a variety of different wire gauge sizes, a number of different cable-assembly constructions are necessary, all having the goal of achieving a circular finished cross-sectional shape. FIG. 13 and FIG. 14 show cross-sections of seven and nineteen pair cable assemblies respectively, constructed from cables A, B, C or D, which form natural circles and therefore are the simplest constructions. The seven pair assembly of FIG. 13 can utilize conductors of 20 AWG or smaller diameter. A jacket 26 composed of PVC, vinyl, nylon or polyethylene sleeving, netting or spiral-wrap surrounds the twisted-pairs contained in the tubing holding the group in a circular shape. Alternately, the individual tubing sections can be grouped together using adhesives applied continuously or periodically along their length. The nineteen pair assembly of FIG. 14 can utilize conductors as small as 26 AWG. FIG. 15 shows the cross-section of a seven pair assembly utilizing tubing 18. FIG. 16 shows the cross-section of a twelve pair configuration that utilizes shaped fillers 27 to achieve a circular shape. FIG. 17 shows the cross-section of a thirteen pair configuration that utilizes D-shaped fillers 28 to achieve a circular shape. The composition of the fillers, 27 and 28 is not important and can be cardboard, paper, cloth, cotton etc. A one-piece flexible extruded sheath as shown in FIG. 13*a* replaces a number of tubing sections with a single molded part 34 containing a number of tunnels for twisted pairs that extend axially, simplifying the construction of multi-pair cables.

Figure 18:
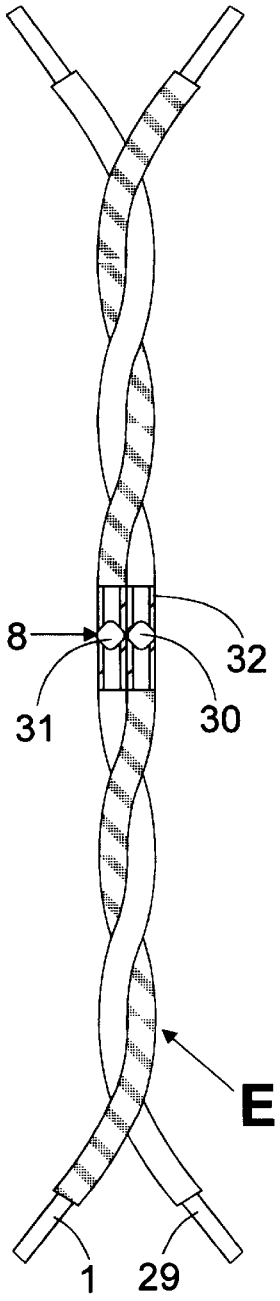
FIG. 18 illustrates twisted-pair cable E of the invention, in which both conductors are insulated.
Figure 19:
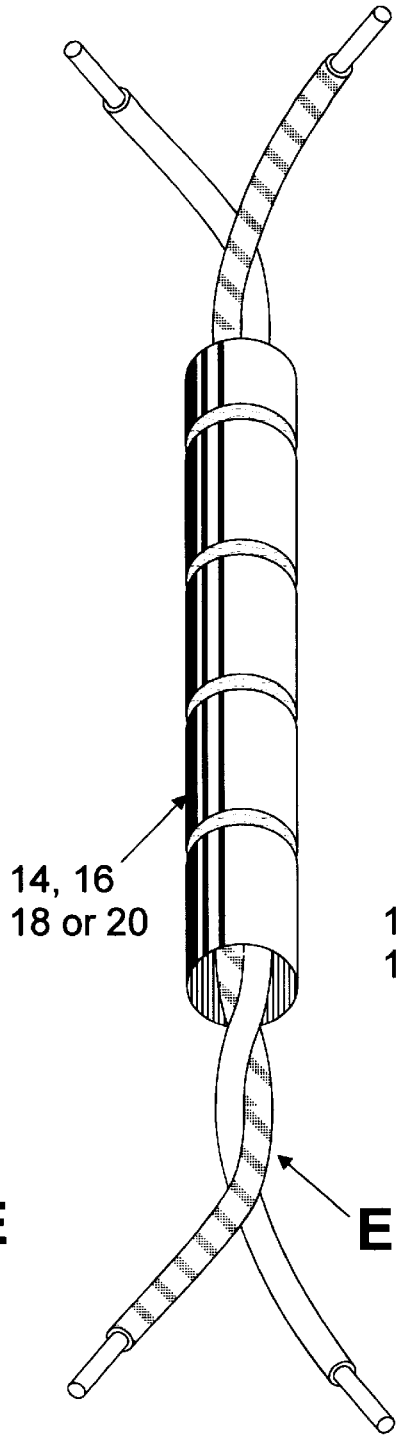
FIG. 19 illustrates twisted-pair cable E of the invention enclosed in gas-filled tubing.
Figure 20:
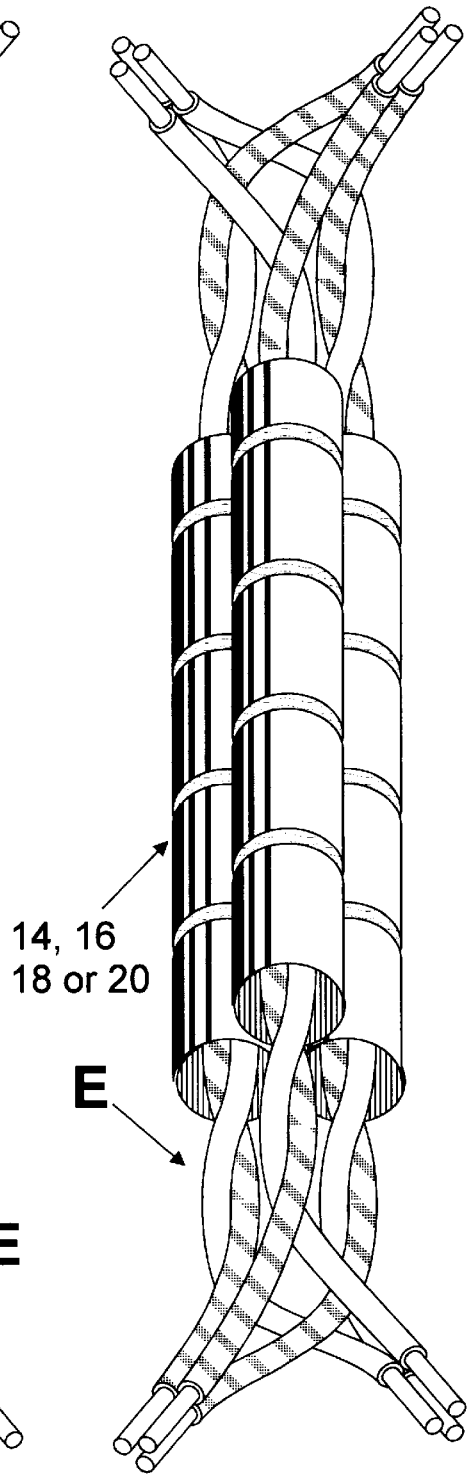
FIG. 20 illustrates a three twisted-pair parallel configuration utilizing twisted-pair cables F each enclosed in gas-filled tubing.

For some applications, only length equalization of insulated twisted-pairs is desired. In this case, the construction of FIG. 18 can be used. To construct this version, insulated conductor 1 is initially twisted with insulated conductor 29 at a twist rate of 9–14 twists per foot. Then the twisted-pair is severed at the midpoint, 8, the conductors 1 and 29 swapped and reconnected at 30 and 31 by twisting the conductors together, welding, soldering, crimping, combinations of these or other electrical joining means, such as connectors. The electrical connections 30 and 31 can be insulated using crimp connectors, plastic tubing, or polyolefin shrink tubing 32 or other insulation technique. FIG. 19 shows the fully insulated, but length equalized twisted-pair cable E enclosed in tubing 14, 16, 18 or 20. FIG. 20 utilizes twisted-pair cable E to construct a multiple-pair cable where the pairs are connected in parallel.

Figure 21:
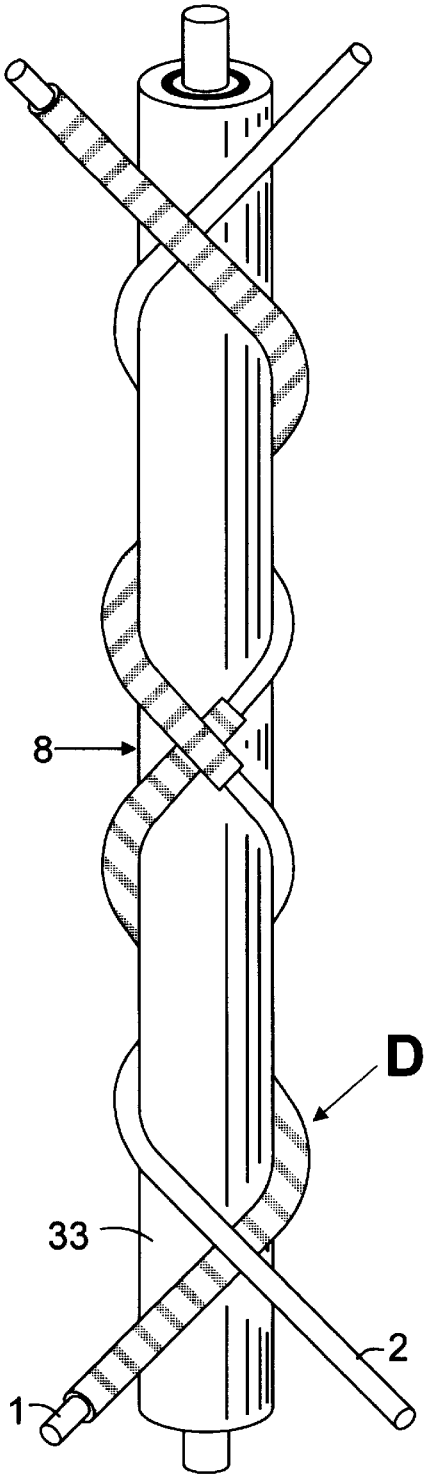
FIG. 21 illustrates twisted-pair cable D of the present invention applied to the construction of U.S. Pat. No. 5,831,210.
Figure 22:
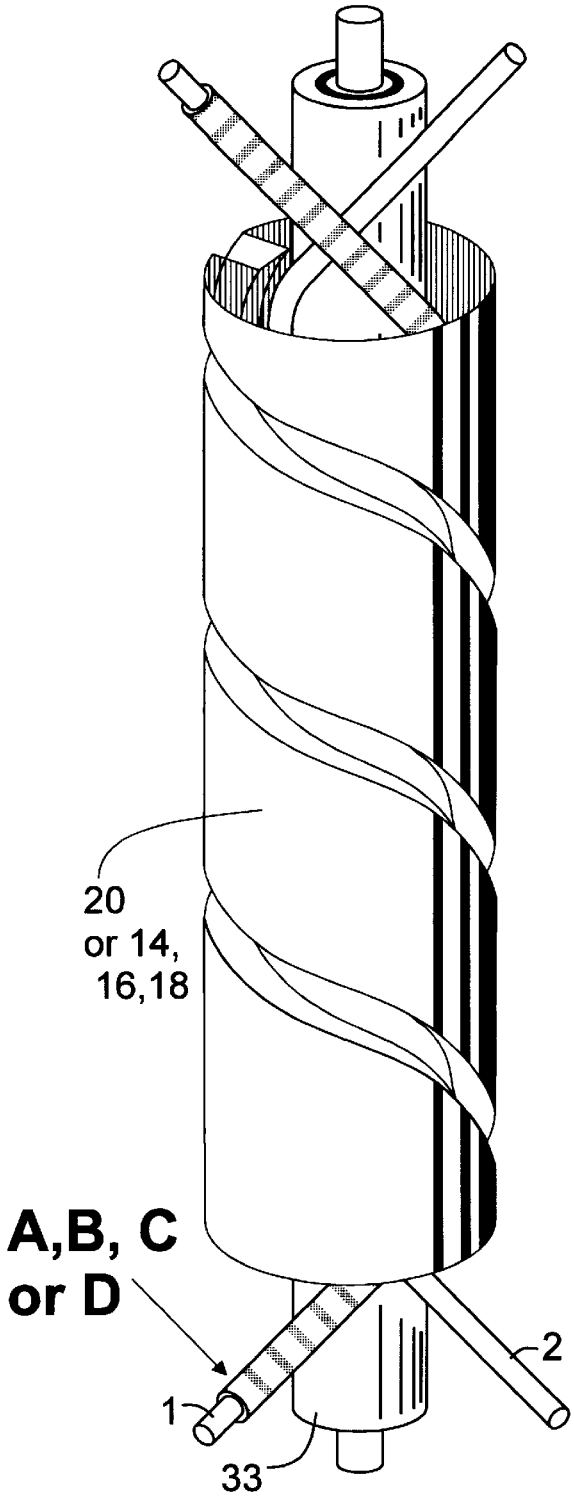
FIG. 22 illustrates twisted-pair cable A, B, C or D of the present invention applied to the construction of U.S. Pat. No. 5,831,210 and further enclosed in gas-filled tubing.
Figure 23:
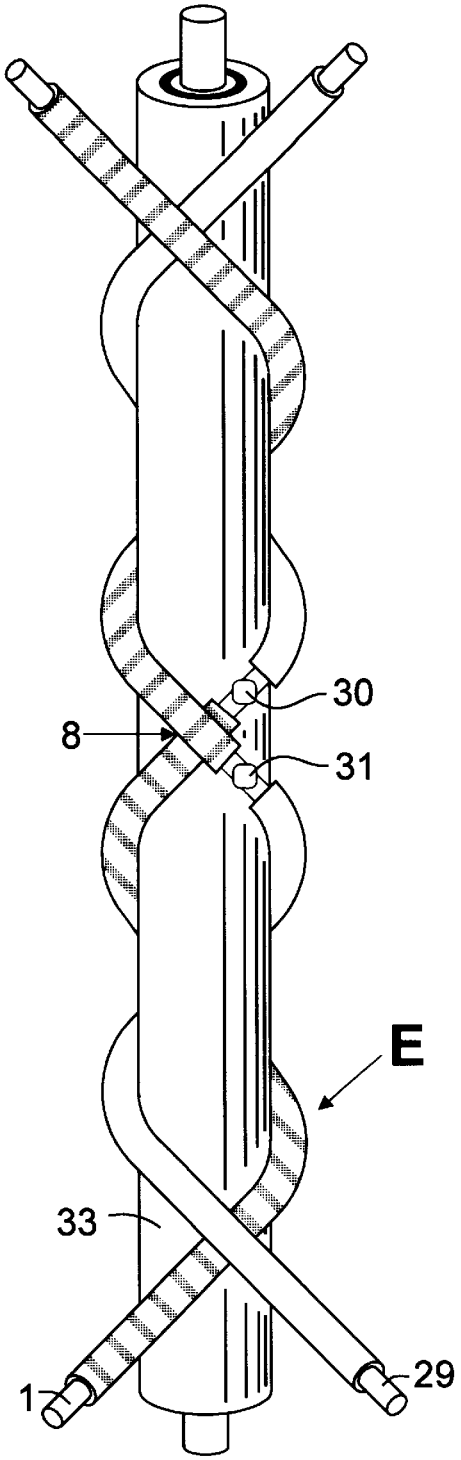
FIG. 23 illustrates twisted-pair cable E of the present invention applied to the construction of U.S. Pat. No. 5,831,210.
Figure 24:
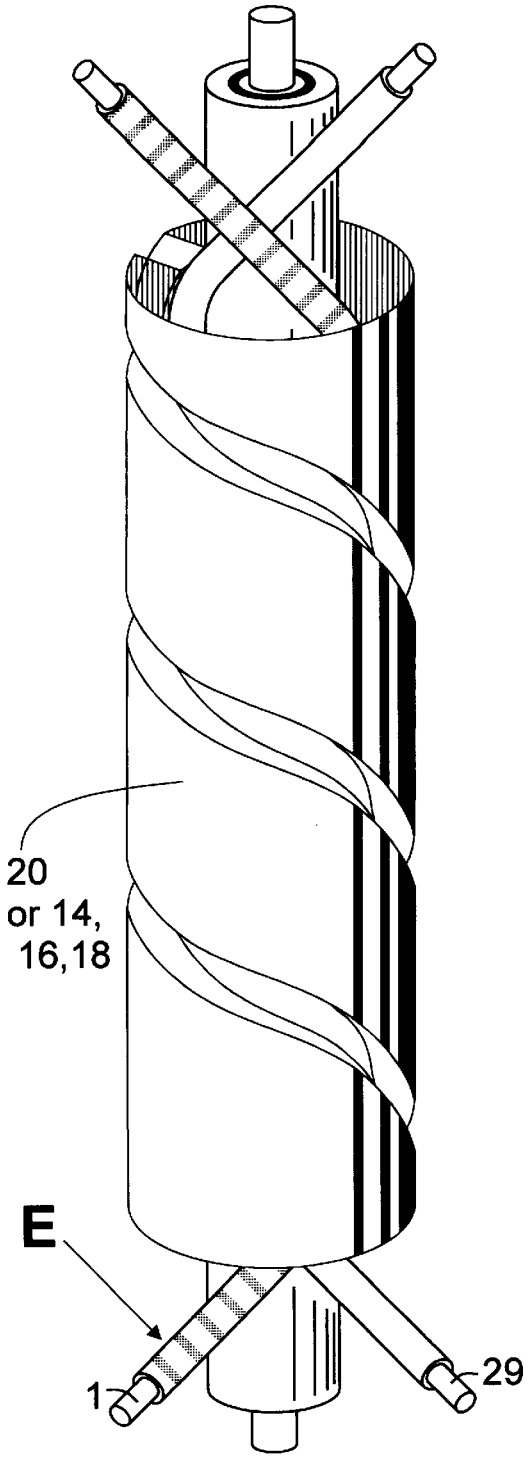
FIG. 24 illustrates twisted-pair cable E of the present invention applied to the construction of U.S. Pat. No. 5,831,210 and further enclosed by gas-filled tubing.

The twisted-pair cable constructions of the present invention can also be applied to single-pair designs such as that taught in Nugent U.S. Pat. No. 5,831,210. FIG. 21 shows the cable construction of Nugent, U.S. Pat. No. 5,831,210, modified to use a twisted-pair of the present invention. In FIG. 21, the signal conductors 1 and 2 comprise a twisted-pair based on the construction of cable D. The insulated ground conductor 33 serves to separate the conductors to reduce capacitive coupling. At the midpoint of the cable, 8, there is an overlap of insulated portions of conductors 1 and 2 to prevent shorting. In order to prevent shorting of external conducting materials to the conductor portions with no insulation and to prevent interactions with external conductors, tubing encloses the twisted-pair as shown in FIG. 22. Alternatively, tubing 20 could be eliminated and 14, 16 or 18 could be substituted for this purpose as well. As shown in FIG. 22, cables A, B, C or D can be applied to the construction of Nugent, U.S. Pat. No. 5,831,210. As shown in FIG. 23, Cable E can be applied to the construction of Nugent, U.S. Pat. No. 5,831,210 as well. FIG. 23 shows the cable construction of Nugent, U.S. Pat. No. 5,831,210 modified to use a twisted-pair E of the present invention. In FIG. 23, the signal conductors 1 and 29 comprise a twisted-pair based on the construction of cable E. The insulated ground conductor 33 serves to separate the conductors to reduce capacitive coupling. At the midpoint of the cable, 8, there is an overlap of insulated portions of conductors 1 and 29 to prevent shorting. Conductors 1 and 29 have been severed at 8 and reconnected in reverse polarity at 30 and 31. Electrical connections 30 and 31 can consist of twisting the conductors together, welding, soldering, crimping, combinations of these or other electrical joining means, such as connectors. In order to prevent interactions with external conductors, tubing 20 can enclosed the twisted-pair as shown in FIG. 24. Alternatively, tubing 20 could be eliminated and 14, 16 or 18 could be substituted for this purpose as well.

Other modifications and substitutions are intended in the foregoing specification, combinations of features will vary and in some cases individual features will be used in the absence of other features.

What is claimed is:

1. A twisted-pair interconnect comprising:

a first conductor having first insulation over a lengthwise first half and being uninsulated over a lengthwise second half; and a second conductor being uninsulated over a lengthwise first half and having a second insulation over a lengthwise second half; and an insulating barrier, wherein said first half of said first conductor is twisted with said first half of said second conductor, said second half of said first conductor is twisted with said second half of said second conductor and said insulating barrier is located at a midpoint to prevent shorting.

2. The interconnect of claim 1, wherein said insulating barrier comprises an overlap of said first insulation and said second insulation at said midpoint.

3. The interconnect of claim 1, wherein said insulating barrier comprises two-piece insulated connectors installed in series with said first conductor and said second conductor at said midpoint.

4. The interconnect of claim 1, wherein said insulating barrier comprises one-piece insulated connectors installed on said first conductor and said second conductor at said midpoint.

5. The interconnect of claim 1, wherein said insulating barrier comprises an insulating sleeve enclosing each of said first conductor and said second conductor at said midpoint.

6. The interconnect of claim 1 wherein said first conductor and said second conductor together define a twisted-pair and further comprising insulating gas-filled tubing enclosing said twisted-pair.

7. The interconnect of claim 6 wherein said tubing further comprises radial ridges which center said twisted-pair within said tubing.

8. The interconnect of claim 6 wherein said tubing further comprises axial ridges which center said twisted-pair within said tubing.

9. The interconnect of claim 6 wherein said tubing further comprises a helical ridge which centers said twisted-pair within said tubing.

10. A twisted-pair interconnect comprising:

a first conductor; and a second conductor, wherein said first and second conductors are twisted together, severed at a midpoint, reversed and reconnected such that said first conductor is connected to said second conductor and said second conductor is connected to said first conductor at said midpoint.

11. The interconnect of claim 10 further comprising insulating gas-filled tubing enclosing said twisted-pair.

12. The interconnect of claim 11 wherein said tubing further comprises radial ridges which center said twisted-pair within the tubing.

13. The interconnect of claim 11 wherein said tubing further comprises axial ridges which center said twisted-pair within the tubing.

14. The interconnect of claim 11 wherein said tubing further comprises a helical ridge which centers said twisted-pair within the tubing.

15. An interconnect comprising:

a plurality of twisted pairs of equal length; and a plurality of gas-filled insulating tubing sections, wherein each of said twisted pairs is enclosed by one of said gas-filled insulating tubing sections, said tubing sections are located together in a bundle, first conductors of said twisted pairs are connected together at a first end to form a first group, second conductors of said twisted-pairs are connected together at said first end to form a second group, said first conductors of said twisted-pairs are connected together at a second end to form a third group and said second conductors of said twisted-pairs are connected together at fourth group.

16. The interconnect of claim 15, wherein said bundle of said tubing sections further comprises a single molded assembly with a plurality of tunnels.

17. A twisted-pair interconnect comprising:

a first signal conductor; and a second signal conductor; and a ground conductor, wherein said ground conductor is substantially straight, said first signal conductor comprises a first uninsulated half and a second insulated half, said second signal conductor comprises a first insulated half and a second uninsulated half, said first signal conductor being wrapped around said ground conductor in a clockwise direction and said second signal conductor being wrapped around said ground conductor and said first signal conductor in a counter-clockwise direction at a lower wrap frequency than said first conductor, causing the length of said first signal conductor and the length of said second signal conductor to be equal.

18. The interconnect of claim 17 further comprising insulating tubing enclosing said first signal conductor, said second signal conductor and said ground conductor.

19. The interconnect of claim 18 wherein said tubing further comprises radial grooves.

20. The interconnect of claim 18 wherein said tubing further comprises axial grooves.

21. The interconnect of claim 18 wherein said tubing further comprises helical grooves.

* * * * *